United States Patent [19]

Ishii et al.

[11] Patent Number: 5,025,599

[45] Date of Patent: Jun. 25, 1991

[54] COMPOUND SEISMIC RESPONSE AND WIND CONTROL SYSTEM

[75] Inventors: Koji Ishii; Kozo Toyama; Jun Tagami, all of Tokyo, Japan

[73] Assignee: Kajima Corporation, Tokyo, Japan

[21] Appl. No.: 465,951

[22] Filed: Jan. 16, 1990

[30] Foreign Application Priority Data

Jan. 17, 1989 [JP] Japan ..... 1-8244

[51] Int. Cl.[5] ..... E04B 1/98; E04H 9/02

[52] U.S. Cl. ..... 52/167 DF; 52/167 R; 52/1

[58] Field of Search ..... 52/167, 167 CB, 167 DF, 52/1

[56] References Cited

U.S. PATENT DOCUMENTS

| | | | |
|---|---|---|---|
| 4,799,339 | 1/1989 | Kobori et al. | 52/167 DF X |
| 4,807,840 | 2/1989 | Baker et al. | 52/167 DF X |

FOREIGN PATENT DOCUMENTS

| | | | |
|---|---|---|---|
| 59-97341 | 9/1984 | Japan | 52/167 DF |
| 164520 | 8/1985 | Japan | 52/167 DF |
| 62-88836 | 4/1987 | Japan | 52/167 |
| 62-88837 | 4/1987 | Japan | 52/167 |
| 591562 | 2/1978 | U.S.S.R. | 52/167 DF |
| 808626 | 2/1981 | U.S.S.R. | 52/167 |
| 1035315 | 8/1983 | U.S.S.R. | 52/167 |

OTHER PUBLICATIONS

Examiner's Amendment 'A'.

*Primary Examiner*—John E. Murtagh
*Assistant Examiner*—Deborah McGann Ripley
*Attorney, Agent, or Firm*—James H. Tilberry

[57] ABSTRACT

A combination active and passive mass damping device to attenuate vibrations in a structure caused by seismic and/or wind forces. A mass is actively rendered vibratable by a hydraulic actuator and passively vibratable by use of springs. The device normally functions as an active mass damper, but, in the event of a power failure, is automatically converted by a failsafe means into a passive mass damping mode.

16 Claims, 4 Drawing Sheets

COMPOUND SEISMIC RESPONSE AND WIND CONTROL SYSTEM

BACKGROUND OF THE INVENTION

1. Field of the Invention

This invention relates to a combination seismic response and wind control system for restraining the vibration of a structure against vibrational disturbances caused by earthquake and wind forces impacting on a structure.

2. Description of the Prior Art

Conventional seismic response and wind control systems installed on structures are of active and passive types. Active seismic response and wind control systems are disclosed in Japanese Patent Laid-open Nos. Sho 62-268478 and Sho 63-156171. These systems include weights and vibrators positioned on the tops of structures. The vibrators vibrate the weights in a controlled manner responsive to the vibrational forces on structures caused by earthquake and wind, whereby the vibration of the structure is attenuated.

As a passive seismic response and wind control system, Japanese Patent Laid-open No. Sho 63-114773 has disclosed a dynamic vibration absorber, in which a weight having a mass corresponding to about one hundredth of the weight of the structure is connected to the structure through a spring having a predetermined natural period of vibration, whereby the vibration of the structure is damped. Also, Japanese Patent Laid-open No. Sho 63-254247 has disclosed a pendulum type dynamic vibration absorber in which a suspension member is used as connecting means for giving a specified natural period to the dynamic vibration absorber.

An active seismic response and wind control system can be expected to exceed the capacity of a passive seismic response and wind control system. However, the active seismic response and wind control system requires external energy to operate the vibrator, whereas the passive seismic response and wind control system does not depend on an external source of energy. Thus, while the active seismic response and wind control system is preferable to a passive seismic response and wind control system, no seismic response and wind control is obtained if the supply of external energy is lost in an emergency.

SUMMARY OF THE INVENTION

The present invention is a combination seismic response and wind control system comprising an active seismic response and wind control system and a passive seismic response and wind control system to automatically provide structure protection when energy to the active seismic response and control system is lost.

The active seismic response and wind control system includes (1) a weight movable relative to the structure, (2) a vibrator to vibrate the weight in response to the vibration of the structure and/or the input vibrational disturbance, and (3) connecting means for connecting the weight to the structure for the vibration of a predetermined natural period. The passive seismic response and wind control system includes (1) the weight, and (2) the connecting means. The passive system serves as a dynamic vibration absorber if the vibrator of the active system is inoperable.

Preferably, a spring or the like is used for the connecting means to give to the weight at least two natural periods, i.e., one for the active seismic response and wind control system, and one for the passive seismic response and wind control system. For this purpose, two separate but interconnected springs may be used in linear alignment. The two springs co-act to provide the required natural frequency in the active system. When switching from the active to the passive system, the frequency of the springs is changed to a frequency suitable for the passive system. This may be accomplished by locking the spring connecting means against vibrational movement, whereby one spring is effectively removed from the system. A pendulum type connecting means is also contemplated for use with a seismic response and wind control system. Suspending members, such as wire rope or chain, in multiple stages, is further contemplated to fix and to release an intermediate pendulum portion employed as the system frequency changer.

According to either system, if the active seismic response and wind control system becomes inoperative, the passive seismic response and wind control system will function to protect the structure.

OBJECTS OF THE INVENTION

An object of the present invention is to provide a seismic response and wind control system comprising in combination both an active and a passive seismic response and wind control system, wherein the passive seismic response and wind control system functions if the active seismic response and wind control system becomes inoperable.

Other objects of the present invention include maintaining the vibration restraining effect on a structure, reducing a sense of fear of residents to the vibration of the structure, preventing apparatuses in the structure from being functionally disordered due to the vibration of the structure, and further reducing the damage to the structure.

DETAILED DESCRIPTION OF THE PREFERRED EMBODIMENT

Hereinafter will be described an embodiment of the combination seismic response and wind control system according to the present invention with reference to the accompanying drawings.

Figure 1:
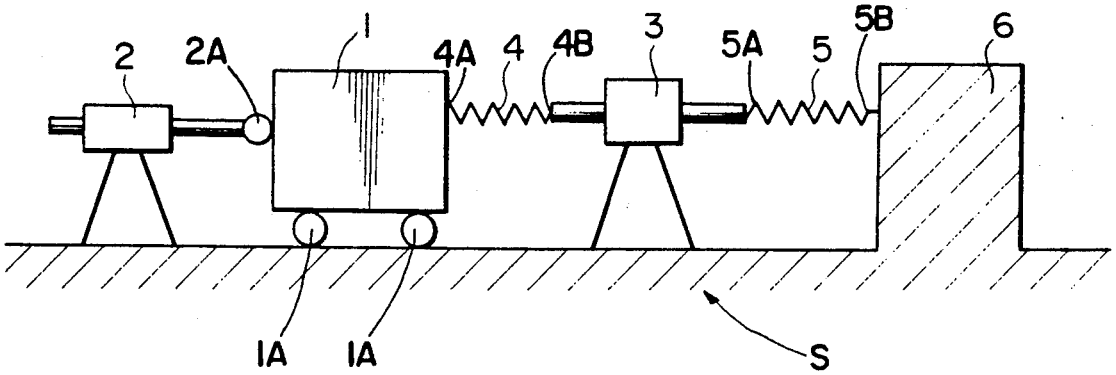
FIG. 1 is a schematic side elevational view showing the principle underlying an embodiment of a combination seismic response and wind control system according to the present invention.

FIG. 1 shows a structures according to the principle of the combination seismic response and wind control system, wherein a weight 1 (mass ) is supported by rollers 1A so as to be freely movable leftward and rightward. A vibrator end 2A of vibrator 2 and a spring end 4A of spring 4 are secured to opposite sides of the weight 1. The spring end 4B is connected through a fixing device 3, which functions as a passive energy means frequency modifier, to end 5A of a second spring 5. Spring end 5B is connected to a portion 6 of structure S. When the fixing device is in a released mode, springs 4 and 5 function as a continuous spring. Upon actuation of vibrator 2, the mechanism functions as an active seimic response and wind control system. The natural period of the system determined by the mass of the weight and the spring is adjusted to the natural period of the structure.

To function in a passive mode, the fixing device 3 is activated to immobilize spring 5 wherein the natural period of spring 4 is modified to a predetermined frequency best suited for passive damping. The fixing device 3 is a failsafe mechanism which automatically shifts the system from active to passive when a power failure occurs. Upon return of power to the vibrator 2, the system again automatically reverts to the active mode.

Figure 2:
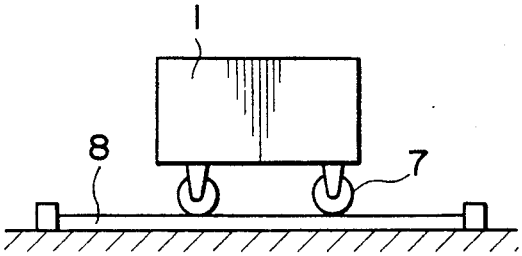
FIG. 2 is a schematic side elevational view showing a weight sliding mechanism similar to the embodiment shown in FIG. 1.

FIG. 2 shows the simplest structure of a weight sliding mechanism in the combination seismic response and wind control system as noted above, in which the weight 1 slides along a rail 8 with rollers 7 provided beneath the weight 1.

Figure 3:
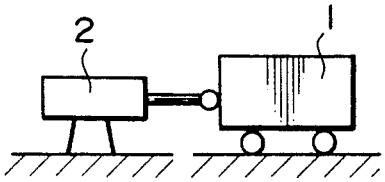
FIGS. 3 and 4 are schematic side elevational views respectively showing two embodiments of vibrators.
Figure 4:
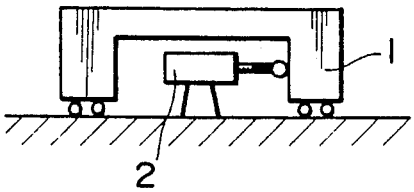

FIG. 3 shows an example of the vibrator 2 which may include either a hydraulic or electric actuator. The vibrator 2 is controlled by a computer, not shown, but well known in the art, according to the input external vibrational force or the vibrational response of the structure. Basically, a vibration of the weight 1 with 90° phase offset will suffice for controlling the vibration of the structure. In the embodiment shown in FIG. 4, the vibrator 2 is received inside the weight 1 having a recess to save space.

Figure 5:
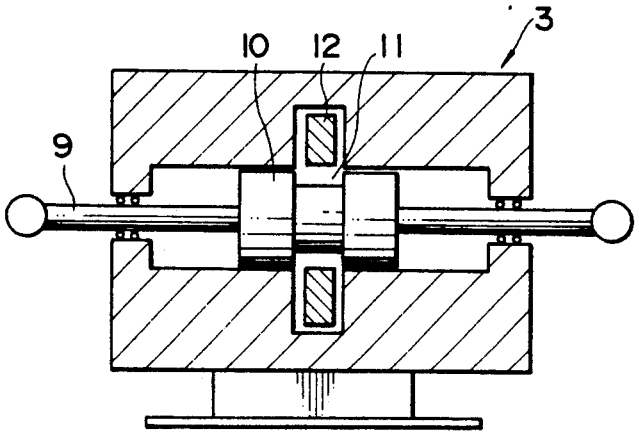
FIG. 5 is an elevational sectional view showing an embodiment of a fixing device.
Figure 6:
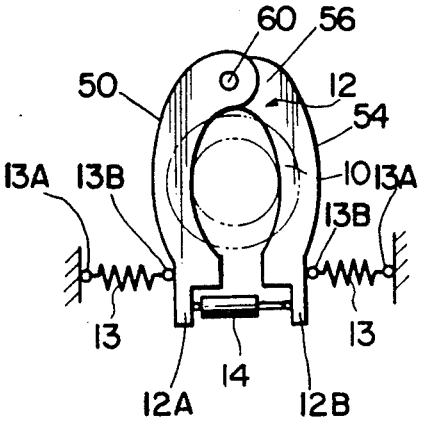
FIG. 6 is a front elevational view showing a stop ring used in the fixing device of FIG. 5.

FIG. 5 shows an example of the fixing device 3, in which a rod 9 is combined with a clamp 12, FIG. 6, adapted to close about a groove 11 of a detent 10 secured to the rod 9. Clamp 12 comprises a first member 50 having a fixed end 52 and a movable end 12A and a second member having a fixed end 54 and a movable end 12B. The first and second members are pivotally secured together at their fixed ends by means of a pivot pin 60. Normally, the clamp 12 is brought into engagement with the groove 11 of the detent 10 by the action of springs 13 secured at their ends 13A and 13B to the fixing device 3 and the free ends 12A and 12B of clamp 12, respectively. In the event of an earthquake shock or vibration due to wind, hydraulic jack 14 is energized to expand the clamp 12 until the rod 9 is freely movable. Should vibrator 2 become inoperative, the pressure to the hydraulic jack 14 is stopped, and clamp 12 is biased by the action of springs 13 into engagement with the groove 11 of the detent 10 to immobilize rod 9.

Figure 8:
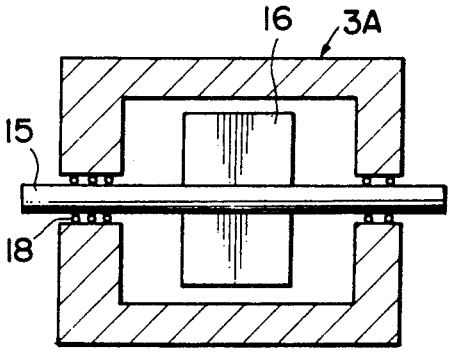
FIG. 8 is an elevational sectional view taken along the line 8—8 of FIG. 7.
Figure 7:
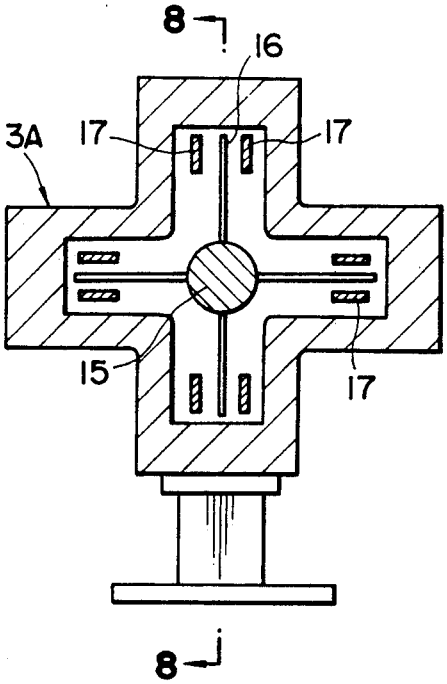
FIG. 7 is an elevational sectional view showing another embodiment of a fixing device.
Figure 9:
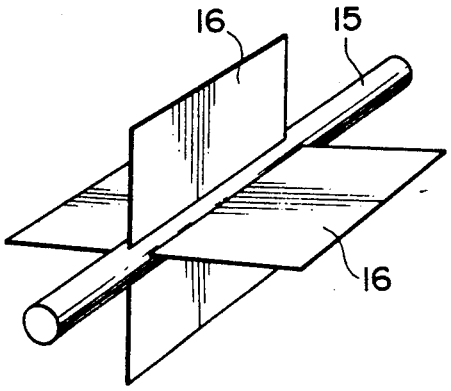
FIG. 9 is a perspective view showing the shiftable portion of the fixing device of FIG. 7.

FIGS. 7 to 9 show another embodiment of a fixing device 3A, in which a rod 15 is provided with a plurality of brake plate members 16 which are selectively grippable by brake means 17. The brake means 17 are normally spring biased into gripping engagement with brake plate members 16 and disengaged by an electric solenoid or hydraulic jack means, not shown, to release rod 15 for free movement in the event of an earthquake.

Figure 10:
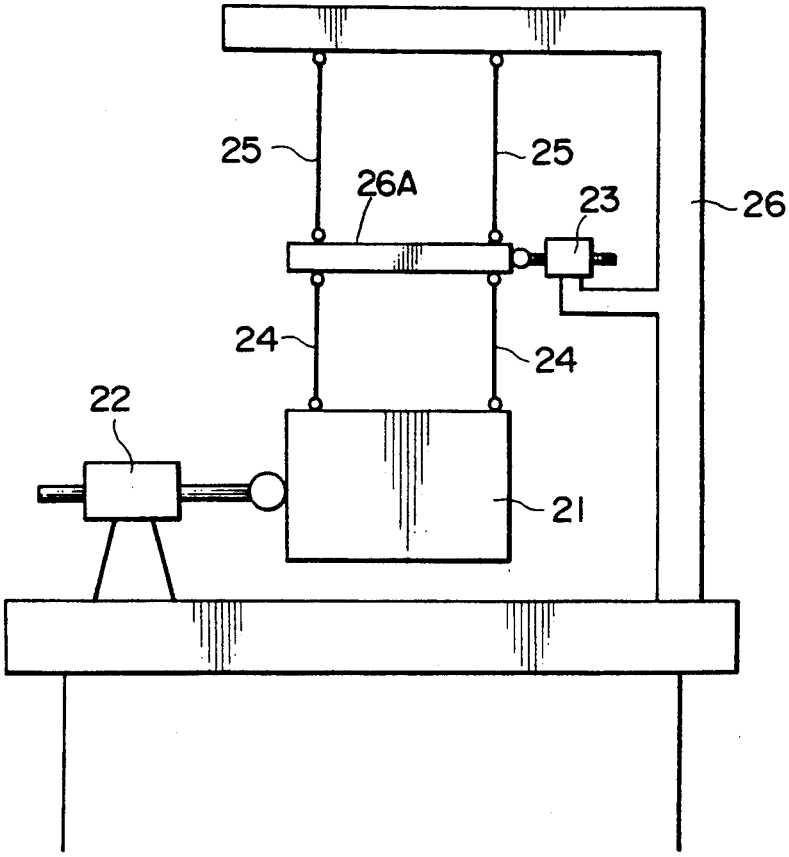
FIG. 10 is a schematic elevational view showing the principle underlying another embodiment of the combination seismic response and wind control system according to the present invention as applied to a pendulum type seismic response and wind control system.

FIG. 10 shows a multistage pendulum type combination seismic response and wind control system as another applied embodiment. A weight 21 is suspended from a support, frame 26 by the use of suspending members 24, 25, and suspension means divider 26A to provide a pendulum. A fixing device 23 is mounted on the support frame 26 and positioned to act against suspending member suspension means divider 26A. Fixing device 23 and suspension means divider 26A coact to function as a pendulum frequency modifier. When the combination seismic response and wind control system is operated as the active seismic response and wind control system by a vibrator 22, the weight 21 and suspending members 24, 25, and 26A comprise a long pendulum when fixing device 23 is released. As soon as the supply of energy to the vibrator 22 is shut off, the fixing device 23 and support frame 26A are immobilized by means such as already described with respect to FIGS. 5 through 9, to convert the combination from a long to a short pendulum system. When the period of the short pendulum is set to the natural period of the structure, the system continues to function as a passive seismic response and wind control system. As such, the vibrator 22 applies a damping force to the weight 21, the value of which may be set to an optimal damping value for passive response to seismic and wind vibrations.

Figure 11:
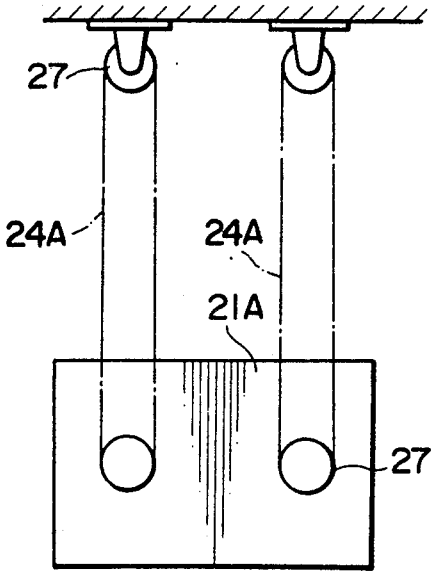
FIGS. 11 and 12 are side and front views, respectively, showing weight suspending means.
Figure 12:
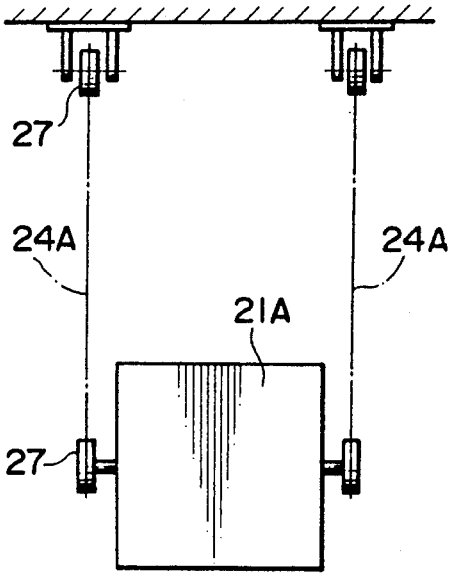

FIGS. 11 and 12 show another embodiment of a pendulum system, in which the weight 21A is suspended by members 24A, such as wire rope and pulleys 27. Though this embodiment is one stage, a two-stage device such as shown in FIG. 10 may be obtained by interposing a member 26A between members 24A of intermediate pulleys 27.

Figure 13:
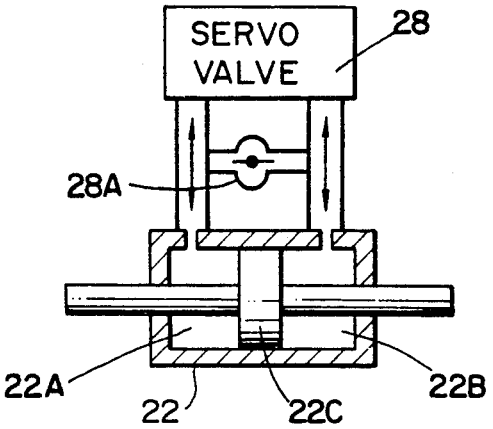
FIG. 13 is a schematic elevational sectional view showing a hydraulic vibrator.
Figure 14:
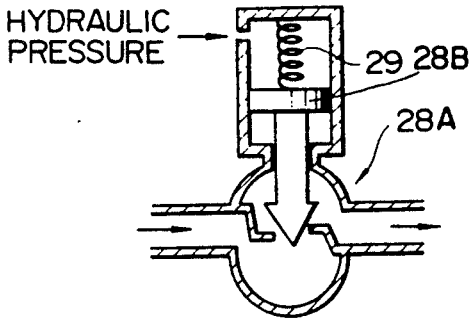
FIG. 14 is a schematic elevational sectional view showing a shield valve for use with the vibrator shown in FIG. 13.

FIG. 13 shows schematically an embodiment of the hydraulic vibrator. In this embodiment, vibrator 22 is provided with a servo valve 28 and a shunt valve 28A, shown in greater detail in FIG. 14. The shunt valve 28A is normally set to the open position by the action of spring 29. When the system is operated as the active seismic response and wind control system, the shunt valve 28A of servo valve 28 is closed by hydraulic pressure against piston 28B, which overcomes the force of spring 29. When the hydraulic pressure is lost due to a malfunction of the seismic response and wind control system, the shunt valve 28A again opens by the force of spring 29, wherein the pressure in chambers 22A and 22B is equalized and piston 22C is immobilized. Vibrator 22 then acts as a damper for the weight 21 of the pendulum when the system functions as the passive seismic response and wind control system.

Figure 15:
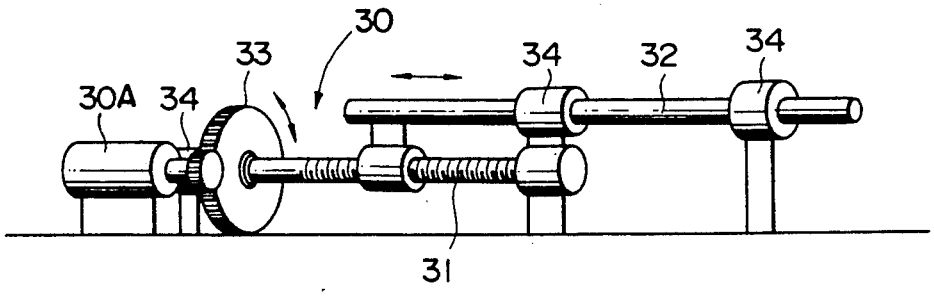
FIG. 15 is a perspective elevational view showing a motor driven vibrator.

FIG. 15 shows an embodiment of a motor vibrator 30 which is so structured that the rotation of a motor 30A is converted through reduction gears 33 and 34 and screw 31 into the linear motion of a rod 32 journaled in bearings 34A.

Figure 16:
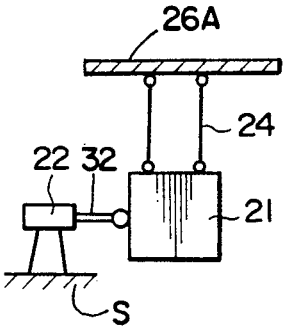
FIG. 16 is a schematic elevational side view showing a method for connecting a vibrator to a weight.
Figure 17:
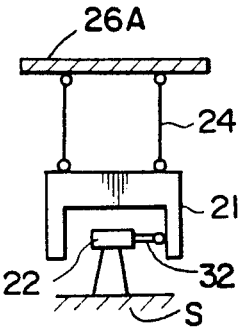
FIGS. 17 and 18 are schematic elevational side and front views, respectively, showing another embodiment of the vibrator and weight.
Figure 18:
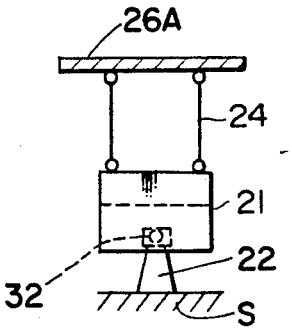

The vibrator 22 may be simply connected to the weight 21 as shown in FIG. 16. However, as shown in FIGS. 17 and 18, when the weight 21 is provided with a recess 34 and the vibrator 22 is received in the recess 34B, a saving of the space is attained. Fixing device 23 of FIG. 10 may be used in conjunction with a member 26A in embodiments of FIGS. 16 through 18.

Numerous modifications and variations of the subject invention may occur to those skilled in the art upon a study of this disclosure. It is therefore to be understood that, within the scope of the appended claims, the invention may be practiced otherwise than as described in the specification and illustrated in the drawings.

What is claimed is:

1. A mass damping device for attenuating vibrations in a structure caused by seismic and/or wind forces, comprising: a vibratable mass having opposite sides and supported by said structure; an actuator secured to one side of said vibratable mass and to said structure, adapted to actively vibrate said mass; passive energy means having a predetermined natural frequency secured to the opposite side of said mass and to said structure; a passive energy means frequency modifier adapted to modify the natural frequency of said passive energy means; power means to drive said actuator; and failsafe means to actuate said passive energy means frequency modifier responsive to a loss of said power means.

2. The device of claim 1, wherein said passive energy means is divided into two parts; connecting means joining said two parts; and said passive energy means frequency modifier being adapted to clamp said connecting means against movement.

3. The device of claim 2, including power means to maintain said passive energy means frequency modifier out of clamping engagement with said connecting means; and mechanical means to urge said passive energy means frequency modifier into clamping engagement with said connecting means.

4. The device of claim 2, wherein said connecting means comprises an elongate rod; plate means integrally secured to said rod and projecting outwardly therefrom; brake means adapted to releasably grip said plate means; mechanical means adapted to urge said brake means into gripping contact with said plate means; and power means adapted to urge said brake means out of gripping contact with said plate means, whereby said mechanical means will automatically grip said plate means upon loss of power to said power means.

5. The device of claim 3, wherein said power means comprise a hydraulic jack device and said mechanical means comprise coiled springs.

6. The mass damping device of claim 1, wherein said actuator comprises a hydraulic cylinder and reciprocatable piston; servo valve means to reciprocate said piston; and shunt valve means adapted to immobilize said piston in the event of a power failure to said actuator.

7. The mass damping device of claim 1, wherein said actuator comprises electric motor drive means; a rotatable shaft driven by said electric motor drive means; a first reciprocatable shaft; and power take-off means from said rotatable shaft adapted to drive said first reciprocatable shaft, said first reciprocatable shaft being adapted to vibrate said mass.

8. The mass damping device of claim 7, including a pinion drive gear on said rotatable shaft; an idler gear in drivable engagement with said pinion gear; a second threaded shaft rotatably drivable by said idler gear; a threaded nut on said second threaded shaft restrained against rotation; said nut being drivingly connected to said first reciprocable shaft and adapted to vibrate said first reciprocatable shaft.

9. A mass damping device for attenuating vibrations in a structure caused by seismic and/or wind forces, comprising: a vibratable mass; an actuator adapted to vibrate said mass; passive energy means having a predetermined natural frequency secured to said mass and to said structure; a passive energy means frequency modifier; power means to drive said actuator; and means to actuate said passive energy means frequency modifier responsive to a loss of said power means, wherein said passive energy means comprises a coiled spring, and said frequency modifier comprises means to clamp said coiled spring intermediate its end portions.

10. The device of claim 9 wherein said clamp means comprises, a first member having a fixed end and a movable end; a second member having a fixed end and a movable end; said fixed ends of said first and second members being pivotally secured together; failsafe mechanical means to urge said movable ends toward each other; power means to urge said movable ends apart; and means to mount said first and second members in clamping relationship on opposite sides of said coiled spring, whereby de-energization of said power means permits said failsafe mechanical means to urge said first and second members into clamping engagement with said coiled spring.

11. A mass damping device for attenuating vibrations in a structure caused by seismic and/or wind forces, comprising: a vibratable mass; an actuator adapted to vibrate said mass; passive energy means having a predetermined natural frequency secured to said mass and to said structure; a passive energy means frequency modifier; power means to drive said actuator; means to actuate said passive energy means frequency modifier responsive to a loss of said power means; said passive energy means comprising a coiled spring; said frequency modifier means comprising clamp means to clamp said coiled spring intermediate its end portions; said clamp means comprising a first member having a fixed end and a movable end; a second member having a fixed end and a movable end; said fixed ends of said first and second members being pivotally secured together; failsafe mechanical means to urge said movable ends toward each other; power means to urge said movable ends apart; means to mount said first and second members in clamping relationship on opposite sides of said coiled spring, whereby de-energization of said power means permits said failsafe mechanical means to urge said first and second members into clamping engagement with said coiled spring; and a clamp rod secured to said coiled spring intermediate the end portions of said coiled spring, said clamp means being adapted to make clamping engagement with said clamp rod.

12. The device of claim 11, wherein said clamp rod is provided with a groove adapted to receive therein said clamp means in clamping engagement therewith.

13. A mass damping device for attenuating vibrations in a structure, caused by seismic and/or wind forces, comprising: a vibratable mass; an actuator adapted to vibrate said mass; means to suspend said mass for free-swinging pendulum-like movement; a pendulum frequency modifier; power means to drive said actuator; power means to deactivate said pendulum frequency modifier; mechanical means to activate said pendulum frequency modifier; means to cut off said power means to said pendulum frequency modifier responsive to a cutoff of power to said actuator; and said frequency modifier being adapted to change the frequency of said free-swinging pendulum-like movement of said vibratable mass responsive to said cut-off of power to said pendulum frequency modifier.

14. The mass damping device of claim 13, wherein said mass suspension means comprise: a suspension means divider; first suspension means secured between said mass and said suspension means divider; second suspension means secured between said suspension means divider and said structure; said frequency modifier being secured to said suspension means divider and adapted to move freely therewith when said actuator is power engaged and to become immobilized when the power is cut off to said actuator, whereby said suspension means divider is immobilized, thereby immobilizing said second suspension means and changing the frequency of said pendulum-like movement of said mass.

15. A mass damping device for attenuating vibrations in a structure, caused by seismic and/or wind forces, comprising: a vibratable mass; an actuator adapted to vibrate said mass; means to suspend said mass for free-swinging pendulum-like movement; a pendulum frequency modifier; power means to drive said actuator; power means to deactivate said pendulum frequency modifier; mechanical means to activate said pendulum frequency modifier; means to cut off said power means to said pendulum frequency modifier responsive to a cut-off of power to said actuator; said frequency modifier being adapted to change the frequency of said free-swinging pendulum-like movement of said vibratable mass responsive to said cut-off of power to said pendulum frequency modifier; said means to suspend said mass comprising a suspension means divider; first suspension means secured between said mass and said suspension means divider; second suspension means secured between said suspension means divider and said structure; said frequency modifier being secured to said suspension means divider and adapted to move freely therewith when said actuator is power engaged and to become immobilizing when the power is cut off to said actuator, whereby said suspension means divider is immobilized, thereby immobilizing said second suspension means and changing the frequency of said pendulum-like movement of said mass; said suspension means comprising wire rope.

16. The mass damping device of claim 15, including pully means secured to said mass, to said suspension means divider, and to said structure; and said wire rope being threaded through said pulley means.

* * * * *